United States Patent [19]

Boberg

[11] 4,419,153

[45] Dec. 6, 1983

[54] PYROTECHNICAL DELAY CHARGE

[75] Inventor: Tore Boberg, Karlskoga, Sweden

[73] Assignee: Aktiebolaget Bofors, Bofors, Sweden

[21] Appl. No.: 377,888

[22] Filed: May 13, 1982

[30] Foreign Application Priority Data

May 21, 1981 [SE] Sweden ..... 8103208

[51] Int. Cl.[3] ..... C06B 43/00

[52] U.S. Cl. ..... 149/22; 149/37; 149/40; 149/42; 149/44; 149/77; 149/83; 149/85

[58] Field of Search ..... 149/22, 37, 40, 44, 149/42, 77, 83, 85

[56] References Cited

U.S. PATENT DOCUMENTS 2,831,760 4/1958 Rejdak ..... 149/40

4,374,686 2/1983 Davitt et al. ..... 149/21

*Primary Examiner*—Stephen J. Lechert, Jr.

*Attorney, Agent, or Firm*—Pollock, Vande Sande & Priddy

[57] ABSTRACT

This invention refers to a pyrotechnical delay charge, i.e. a pyrotechnical charge having a very well defined rate of burning. Similar delay charges are generally used in military fuses of various types. The delay charge according to the invention is distinguished by its components and their proportions relative to each other. Within the framework of the limits stated in the patent claims, the delay charges rate of burning can be varied from approximately 2 to approximately 30 mm/s. Characteristic for this delay charge is primarily that it contains more than 10% by weight tin dioxide ($SnO_2$) which acts as an oxidizer and slag former.

20 Claims, No Drawings

PYROTECHNICAL DELAY CHARGE

It is generally known among experts in this field that it is a great deal more difficult to produce slow burning delay charges than it is to produce rapidly burning delay charges. One of the great advantages with the delay charge according to the invention is therefore that it functions exceedingly well even in its relatively slow burning versions with rates of burning from 2 mm/s and upwards.

Even in its relatively rapid burning versions with rates of burning of up to 30 mm/s, the composition according to the invention functions very well.

Another advantage with the delay charge according to the invention is that all indications are that it will have a very good storage durability. This particular delay charge composition has made it possible to avoid the use of barium chromate which has previously been used frequently in this context, and which due to its suspected cancer causing qualities is a component which should obviously be avoided.

In addition to the difficulties in producing generally slow burning delay charges having uniform, well defined rates of burning, the charges must also burn almost completely gas-free as the presence of gas would alter the burning characteristics of the delay charge, as it burns sealed in a channel or equivalent intended for this purpose, in the fuze where it is used. Principally for the same reason, it is a requirement that delay charges produce a firm slag. The delay charge according to the invention fulfils all of these requirements.

It has also been possible to ascertain that the delay charge according to the invention is easier to produce than previous types as it is easier to make compact and has a better mechanical strength.

The main condition for the delay charge according to the invention is that it contains more than 10% by weight tin dioxide ($Sn\ O_2$) which acts as an oxidiser and slag former.

It has also been found that titan, zirconium, or zirconium alloys containing nickel are extremely well suited as fuels in this context.

Similar fuels are in themselves not new in pyrotechnical charges, but when combined with this obligatory $Sn\ O_2$ additive, a surprising technical effect can be spoken of. Through U.S. Pat. No. 3,188,799 it is thus previously known that alloys of zirconium and nickel are used in delay charges, and through Swedish patent 75.10284-8 it is previously known that the same type of fuel is used in priming charges.

One specific delay charge according to the invention contains in addition to the more than 10% by weight, $Sn\ O_2$, and 2 to 20% by weight titanium or zirconium containing fuel, even 40 to 70% by weight bismuth trioxide ($Bi_2\ O_3$). The zirconium containing fuel preferably consists therefore of an alloy containing nickel in which the zirconium content lies between 70 and 30% by weight, while the rest consists of alloy substances. Further, the delay charge according to the invention may contain 0 to 20% by weight antimony, or alternatively 0 to 20% by weight of a nickel alloy containing up to 30% by weight zirconium. Finally, even 0 to 10% by weight $KClO_4$ may be included.

It may even be necessary to add a small amount of bonding agent. For this purpose small amounts (0.2 to 4% by weight) of acrylic bonding agent have been used.

One specific delay charge according to the invention having a rate of burning of approximately 5 mm/s therefore contains 20% by weight $Sn\ O_2$, approximately 9% by weight Zr/Ni (70/30), 8% by weight Sb, 5% by weight $KClO_4$, 58% by weight $Bi_2\ O_3$, and 0,5% by weight acrylic bonding agent.

Another version of the pyrotechnical delay charge according to the invention contains 20 to 90% by weight tin dioxide ($Sn\ O_2$), 0 to 20% by weight antimony (Sb) or alternatively a zirconium nickel alloy (30/70), 0 to 10% by weight potassium perchlorate ($KClO_4$), 0 to 50% by weight titanium dioxide ($Ti\ O_2$) or alternatively zirconium dioxide ($Zr\ O_2$) and 3 to 15% by weight boron (B) and the required amount of acrylic bonding agent of approximately 0,5% by weight.

The delay charge according to the invention is defined in the patent claims and shall now be further described in the following example.

EXAMPLE

The rates of burning for all the test charges defined below were determined by pressing the charges in a steel cylinder having a circular inner cross-section of 3,5 mm in diameter and a total length of 15 mm. Each test charge was ignited at one end by means of a rapid priming pellet, and the rate of burning from this ignition to the ignition of a rapid final pellet located at the other end of the 15 mm long test charge was measured accurately. The rate of burning stated in each specific example is a rounded off mean value from several experiments involving test charges of identical composition.

All the examples of delay charges in accordance with the invention and defined below were also subjected to a storage test conducted in a humid environment (90% RH) for a period of one year. Upon conclusion of the tests, the charges were examined, and they were found to be practically unaffected in spite of the extremely rigorous storage conditions.

Temperature controlled storage for one year at +80° C. without adverse effect.

| | |
|---|---|
| TEST CHARGE 1 | 20% by weight $SnO_2$ |
| | 13% by weight Zr/Ni (70/30) |
| | 15% by weight Sb |
| | 5% by weight $KClO_4$ |
| | 47% by weight $Bi_2O_3$ |
| | Rate of burning 11 mm/s |
| TEST CHARGE 2 | 20% by weight $SnO_2$ |
| | 10% by weight Zr/Ni (70/30) |
| | 10% by weight Sb |
| | 5% by weight $KClO_4$ |
| | 55% by weight $Bi_2O_3$ |
| | Rate of burning 7 mm/s |
| TEST CHARGE 3 | 50% by weight $SnO_2$ |
| | 31% by weight $TiO_2$ |
| | 10% by weight Sb |
| | 4% by weight B |
| | 5% by weight $KClO_4$ |
| | +0,5% by weight acrylic bonding agent |
| | Rate of burning 2,5 mm/s |
| TEST CHARGE 4 | 55% by weight $SnO_2$ |
| | 22% by weight $TiO_2$ |
| | 8% by weight Sb |
| | 10% by weight B |
| | 5% by weight $KClO_4$ |
| | +0,5% by weight acrylic bonding agent |
| | Rate of burning 10 mm/s |

I claim:

1. A pyrotechnical delay charge for rates of burning between 2 and 30 mm/s which comprises at least 10% by weight tin dioxide ($SnO_2$) as an oxidizer and slag former; 2 to 20% by weight of a fuel containing a member from the group of titanium and zirconium; and 40 to 70% by weight of bismuth trioxide.

2. A pyrotechnical delay charge in accordance with claim 1 which comprises 10 to 30% by weight tin dioxide ($SnO_2$), 2 to 20% by weight titanium or zirconium, or a zirconium alloy containing nickel and 40 to 70% by weight bismuth trioxide ($Bi_2O_3$).

3. A pyrotechnical delay charge in accordance with claim 2 which further comprises 0 to 20% by weight antimony, 0 to 20% by weight of a zirconium and nickel alloy, and 0 to 10% by weight potassium perchlorate ($KClO_4$).

4. A pyrotechnical delay charge in accordance with claims 2 or 3 wherein the ratio of zirconium to nickel in the zirconium alloy is within the range 70:30 to 30:70 parts by weight.

5. A pyrotechnical delay charge in accordance with claim 1 having the following composition:

| | |
|---|---|
| Zr/NI (70/30) | 9% by weight |
| Sb | 8% by weight |
| $KClO_4$ | 5% by weight |
| $Bi_2O_3$ | 58% by weight |
| $SnO_2$ | 20% by weight. |

6. The pyrotechnical delay charge of claim 1 which additionally contains 4% or less by weight of an acrylic bonding agent.

7. The pyrotechnical delay charge of claim 2 which additionally contains 4% or less by weight of an acrylic bonding agent.

8. The pyrotechnical delay charge of claim 3 which additionally contains less than 4% by weight of an acrylic bonding agent.

9. The pyrotechnical delay charge of claim 7 wherein the ratio of zirconium to nickel in the zirconium alloy is 70:30 to 30:70 parts by weight.

10. The pyrotechnical delay charge of claim 5 which additionally contains 4% or less by weight of an acrylic bonding agent.

11. A pyrotechnical delay charge for rates of burning between 2 and 30 mm/s which comprises 20% to 90% by weight tin dioxide ($SnO_2$), 3 to 15% by weight boron (B), 0 to 50% by weight titanium dioxide ($TiO_2$), or zirconium dioxide ($ZrO_2$) 0 to 10% by weight potassium perchlorate ($KClO_4$), and 0 to 20% by weight antimony (Sb), or a zirconium-nickel alloy of ratio 30:70.

12. The pyrotechnical alloy charge of claim 11 which contains 50% by weight of $SnO_2$, 31% by weight of $TiO_2$, 10% by weight of Sb, 4% by weight of B, and 5% by weight of $KClO_4$.

13. The pyrotechnical delay charge of claim 12 which additionally contains 0.5% by weight of an acrylic bonding agent.

14. The pyrotechnical delay charge of claim 11 which contains 55% by weight $SnO_2$, 22% by weight of $TiO_2$, 8% by weight Sb, 10% by weight B, and 5% by weight $KClO_4$.

15. The pyrotechnical delay charge of claim 14 which additionally contains 0.5% by weight of an acrylic bonding agent.

16. The pyrotechnical delay charge of claim 11 which additionally contains about 0.5% by weight of an acrylic bonding agent.

17. The pyrotechnical delay charge of claim 5 which additionally contains about 0.5% by weight of an acrylic bonding agent.

18. The pyrotechnical delay charge of claim 1 which additionally contains 0.2 to 4% by weight of an acrylic bonding agent.

19. The pyrotechnical delay charge of claim 1 which contains 20% by weight $SnO_2$; 13% by weight zirconium-nickel alloy of ratio of 70:30; 15% by weight of Sb, 5% by weight of $KClO_4$, and 47% by weight of $Bi_2O_3$.

20. The pyrotechnical delay charge of claim 1 which contains 20% by weight of $SnO_2$; 10% by weight zirconium-nickel alloy of ratio of 70:30; 10% by weight of Sb; 5% by weight of $KClO_4$; and 55% by weight of $Bi_2O_3$.

* * * * *